US010443867B2

(12) United States Patent
Liu et al.

(10) Patent No.: US 10,443,867 B2
(45) Date of Patent: Oct. 15, 2019

(54) DEHUMIDIFIER

(71) Applicant: Gree Electric Appliances, Inc. of Zhuhai, Zhuhai (CN)

(72) Inventors: Qiuhua Liu, Zhuhai (CN); Jianqun Yang, Zhuhai (CN); Zhi An, Zhuhai (CN); Jie Yang, Zhuhai (CN); Xia Wu, Zhuhai (CN); Panxing He, Zhuhai (CN); Kaiwen Du, Zhuhai (CN)

(73) Assignee: GREE ELECTRIC APPLIANCE, INC. OF ZHUHAI, Zhuhai (CN)

( * ) Notice: Subject to any disclaimer, the term of this patent is extended or adjusted under 35 U.S.C. 154(b) by 374 days.

(21) Appl. No.: 15/139,335

(22) Filed: Apr. 27, 2016

(65) Prior Publication Data

US 2016/0238264 A1 Aug. 18, 2016

Related U.S. Application Data

(63) Continuation of application No. PCT/CN2014/086158, filed on Sep. 9, 2014.

(30) Foreign Application Priority Data

Oct. 28, 2013 (CN) ..... 2013 2 0668183 U

(51) Int. Cl.
*F24F 3/14* (2006.01)
*F24F 13/24* (2006.01)

(52) U.S. Cl.
CPC ..... *F24F 3/1405* (2013.01); *F24F 3/14* (2013.01); *F24F 13/24* (2013.01); *F24F 2003/1446* (2013.01)

(58) Field of Classification Search
CPC ..... F24F 13/084; F24F 2003/1446; F24F 2013/202; F24F 13/20; F24F 13/24
See application file for complete search history.

(56) References Cited

U.S. PATENT DOCUMENTS 5,327,956 A * 7/1994 Bolton ..... F24F 1/025 165/121
5,536,917 A * 7/1996 Suppelsa ..... B29C 65/08 156/752

(Continued)

FOREIGN PATENT DOCUMENTS

CN 1699851 A 11/2005
CN 101684956 A 3/2010

(Continued)

OTHER PUBLICATIONS

International Search Report dated Dec. 4, 2014 of International Patent Application PCT/CN2014/086158.

*Primary Examiner* — Ana M Vazquez
(74) *Attorney, Agent, or Firm* — Franklin & Associates International Inc; Matthew Lambrinos

(57) ABSTRACT

Disclosed is a dehumidifier, including a main body (300) and a front panel (200); a compressor is arranged in the main body (300), and is positioned at the bottom of the main body (300), the front panel (200) is arranged on the outside of the main body (300); the dehumidifier further comprises a lower seal panel (100) for shielding the compressor; the lower seal panel (100) is disposed on the main body (300) and positioned between the front panel (200) and the compressor.

13 Claims, 4 Drawing Sheets

(56) References Cited

U.S. PATENT DOCUMENTS

| | | | | |
|---|---|---|---|---|
| 5,622,058 | A * | 4/1997 | Ramakrishnan | F24F 13/20 62/295 |
| 6,572,085 | B2 * | 6/2003 | Bloemer | F24F 6/04 126/113 |
| 2002/0144513 | A1 * | 10/2002 | Gunji | F24F 1/0007 62/263 |
| 2006/0232080 | A1 * | 10/2006 | Washington | E05B 9/08 292/337 |

FOREIGN PATENT DOCUMENTS

| | | | | |
|---|---|---|---|---|
| CN | 102003744 | A | 4/2011 | |
| CN | 201875820 | U | 6/2011 | |
| CN | 102200326 | A | 9/2011 | |
| CN | 203642342 | U | 11/2014 | |
| WO | 2013141470 | A1 | 9/2013 | |
| WO | WO 2013141470 | A1 * | 9/2013 | F04B 39/0033 |

* cited by examiner

DEHUMIDIFIER

CROSS REFERENCE TO RELATED APPLICATIONS

This application is a continuation of International Patent Application No. PCT/CN2014/086158, entitled "Dehumidifier", filed Sep. 9, 2014, which claims the benefit of the priority of Chinese Patent Application No. 201320668183.5, filed on Oct. 28, 2013, entitled "Dehumidifier", and the entire content of which are incorporated herein by reference.

TECHNICAL FIELD

The present disclosure relates to the technical field of household appliances, more particularly, to a dehumidifier.

BACKGROUND

At present, the configuration of the household dehumidifier includes an upper compartment and a lower compartment; an evaporator, a condenser, a fan and other components are arranged in the upper compartment, and a compressor, an electric box, a water tank and so on are arranged in the lower compartment. As the dehumidifier has an integral construction, louder noises will be produced when the compressor is running indoors, which will affect the using performance.

Considering the above defects, inventors finally obtained the present invention after a long period of research and practice.

SUMMARY

In view of the above, it is necessary to provide a dehumidifier with lowered noises from the compressor so as to solve problems such as noises produced by the compressor when the dehumidifier is in operation. The present disclosure is realized by the following technical schemes:

A dehumidifier comprises a main body and a front panel, a compressor is arranged in said main body, and is positioned at a bottom of said main body, said front panel is arranged on an outside of said main body;

wherein, a lower seal panel for shielding said compressor is further included, said lower seal panel is disposed on said main body and positioned between said front panel and said compressor.

In one embodiment, at least one elastic member is disposed between said lower seal panel and said front panel.

In one embodiment, said elastic member is fixedly disposed on said lower seal panel.

In one embodiment, said elastic member is an elastic plastic part or a spring.

In one embodiment, said elastic plastic part has a sheet shape, and is disposed at an edge of said lower seal panel, and one side of said elastic plastic part is connected with said lower seal panel, while the other sides of said elastic plastic part are separated from said lower seal panel;

a distal end of said elastic plastic part away from the side connected to said lower seal panel is inclined outwards from said lower seal panel.

In one embodiment, said elastic plastic part and said lower seal panel are formed integrally.

In one embodiment, a latching slot is disposed on said front panel at a position corresponding to a position of said elastic plastic part disposed on said lower seal panel.

In one embodiment, the shape of said latching slot is adapted to the shape of said elastic plastic part.

The benefits of the present disclosure are as followings:

The dehumidifier of the present disclosure has a simple and reasonable configuration, the compressor is arranged in the main body, a lower seal panel is disposed on the outside of the compressor for shielding the compressor and reducing noises produced when the compressor is running; the lower seal panel is positioned between the main body and the front panel, such that, when washing and repairing the dehumidifier, only the front panel needs to be removed, while the compressor is shielded by the lower seal panel, which ensures the security.

BRIEF DESCRIPTION OF THE DRAWINGS

FIG. 7 is a right side enlarged view of the area B of the lower seal panel shown in FIG. 6; wherein,

100—lower seal panel; 110—elastic plastic part; 200—front panel; 300—main body.

DETAILED DESCRIPTION OF THE PREFERRED EMBODIMENTS

In order to make the objective, the technical schemes and the benefits of the present disclosure to be more apparent, the dehumidifier of the present disclosure will be described in more details through the following embodiments with reference to the accompanying figures. It should be understood that the embodiments described herein is only for explaining the present disclosure, but not for limiting the present disclosure.

See FIG. 1 to FIG. 7, the dehumidifier of the present disclosure comprises a main body 300, a lower seal panel 100 and a front panel 200. A compressor (not shown) is arranged in the main body 300, and the compressor is positioned at the bottom of the main body 300. The lower seal panel 100 is disposed on the main body 300, and positioned between the front panel 200 and the compressor.

Figure 1:
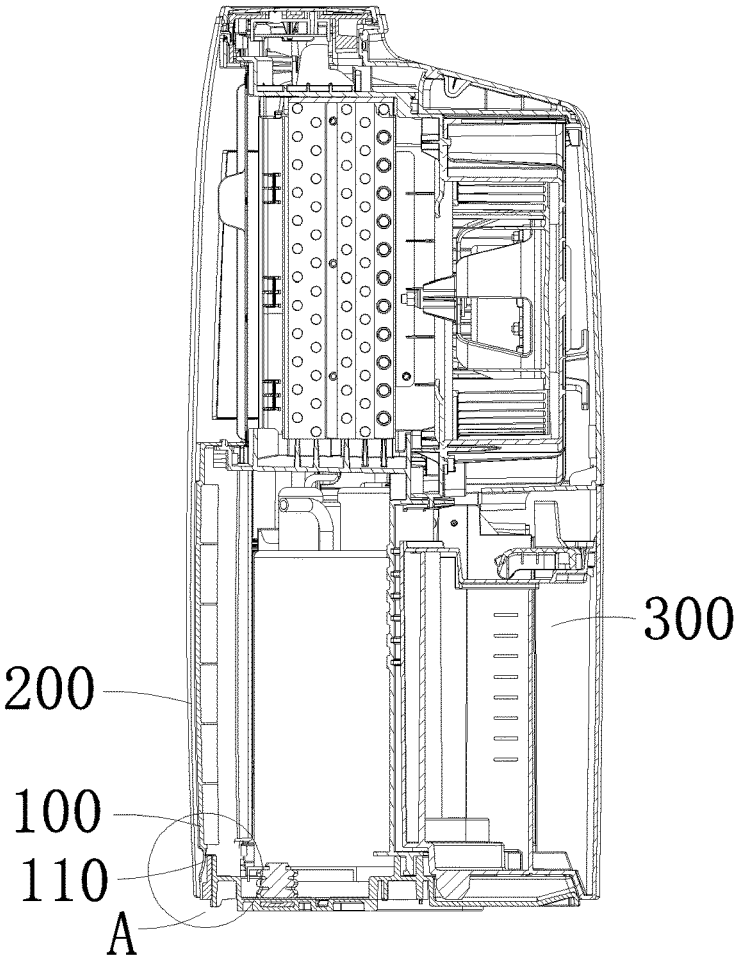
FIG. 1 is a section view illustrating the dehumidifier according to one embodiment of the present invention.
Figure 3:
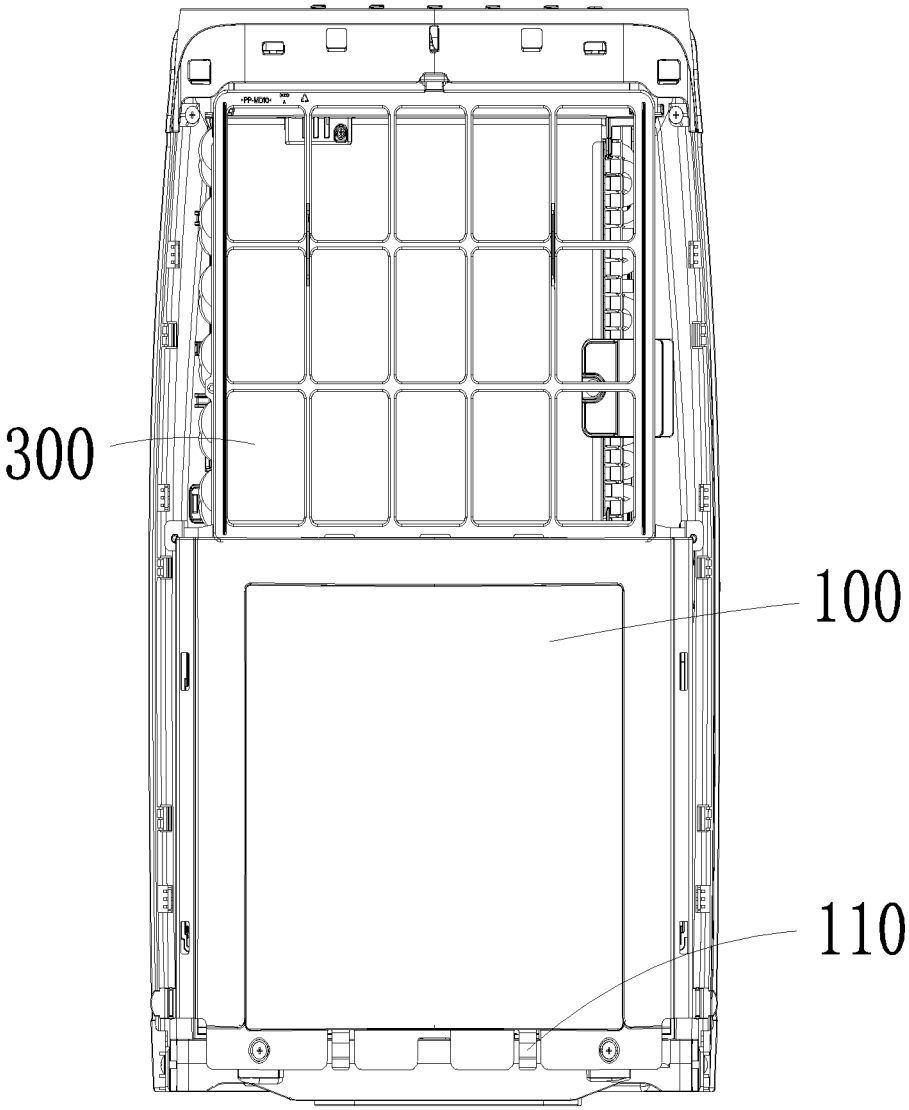
FIG. 3 is a back view illustrating the dehumidifier shown in FIG. 1, wherein the front panel is removed.

As shown in FIG. 1 and FIG. 3, the lower seal panel 100 is arranged for shielding the compressor, the electric box, the wire-lines and pipes and so on, and provides functions of sound insulation, electrical security and aesthetical appearance. When assembling, the lower seal panel 100 is firstly disposed at the bottom of the main body 300 for shielding the compressor, the electric box and wire-lines and so on; then the front panel 200 is mounted on the main body 300. When washing and repairing the dehumidifier, only the front panel 200 needs to be removed, while the compressor is shielded by the lower seal panel 100 so that the user can not touch the electrical components, which ensures the security during washing and repairing.

As one embodiment, an elastic member is disposed between the lower seal panel 100 and the front panel 200, the elastic member is arranged at the edge of the lower seal panel 100.

Furthermore, there is at least one elastic member, that is, there may be one or multiple elastic members, the multiple elastic members are distributed uniformly along the edge of the lower seal panel 100. The elastic member is tightly attached to the front panel 200, so as to prevent the front panel 200 from loosing and releasing, at the meantime to avoid abnormal noises generated by the front panel 200 due to shock.

Figure 2:
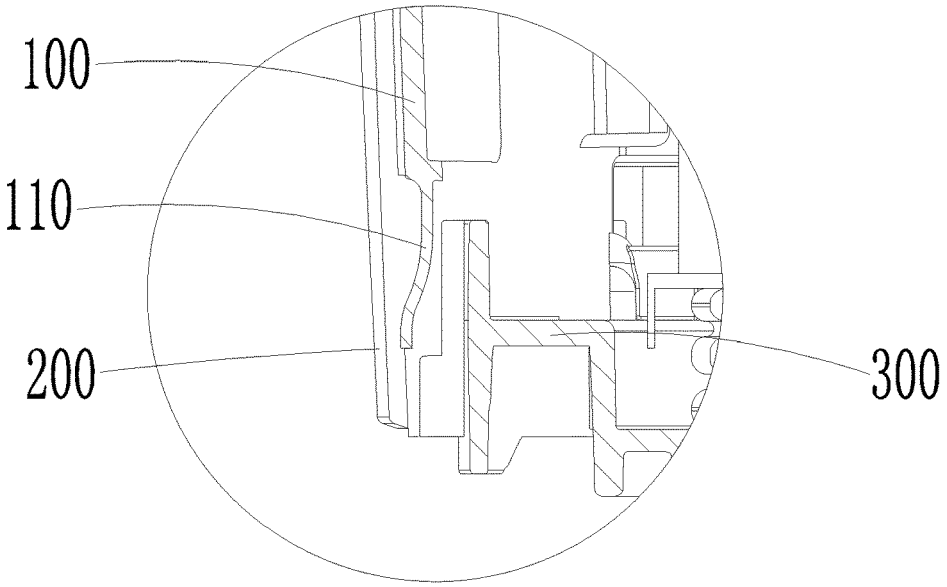
FIG. 2 is an enlarged view of the area A of the dehumidifier shown in FIG. 1.
Figure 4:
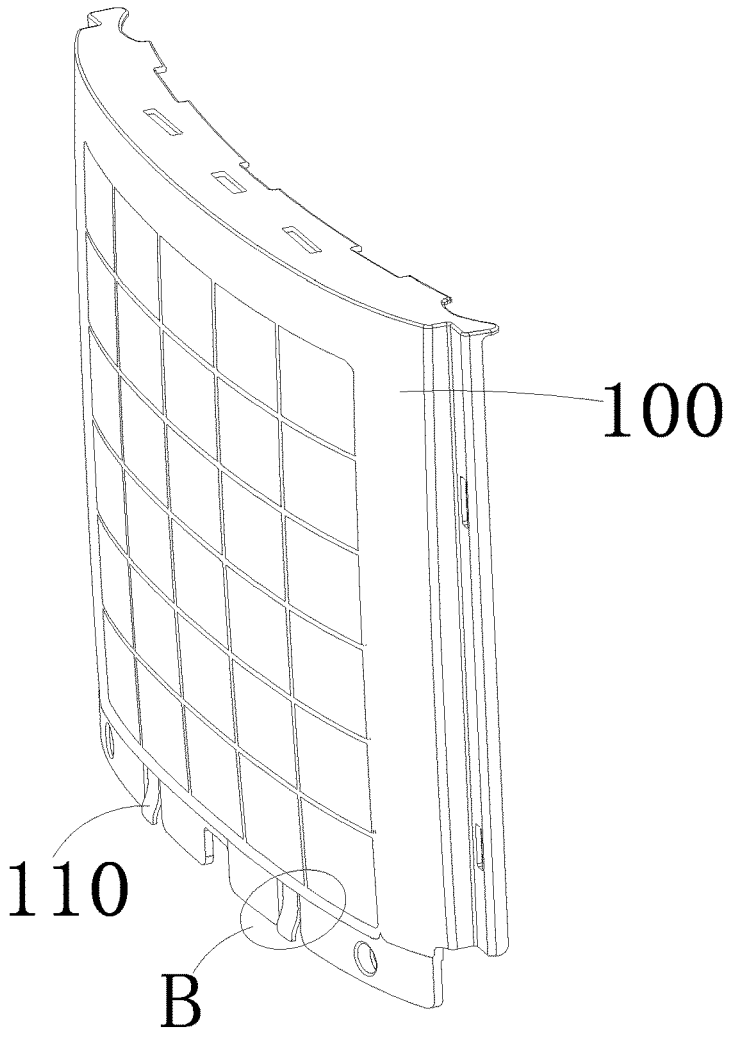
FIG. 4 is a schematic perspective view illustrating the lower seal panel of the dehumidifier shown in FIG. 1.

As one embodiment, the elastic member is an elastic plastic part 110 or a spring. As shown in FIG. 2 and FIG. 4, in this embodiment, the elastic member is an elastic plastic part 110.

Figure 5:
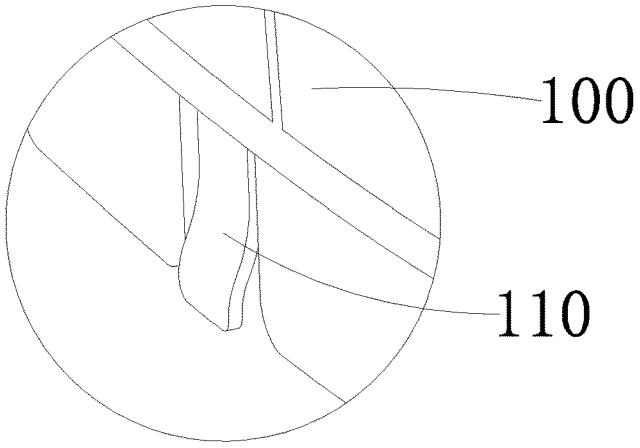
FIG. 5 is an enlarged view of the area B of the lower seal panel shown in FIG. 4.

As shown in FIG. 5, two elastic plastic parts 110 are uniformly arranged at the lower end edge of the lower seal panel 100, which can ensure that the preloads applied by the elastic plastic part 110 on the front panel 200 are uniform. Furthermore, the elastic plastic part 110 is fixedly disposed on the lower seal panel 100.

Figure 6:
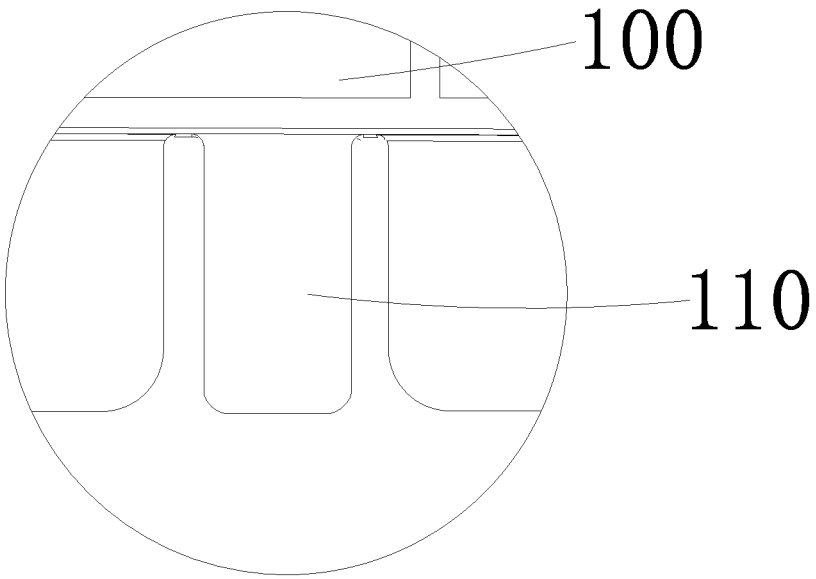
FIG. 6 is a front view of the enlarged view of the area B of the lower seal panel shown in FIG. 5.
Figure 7:
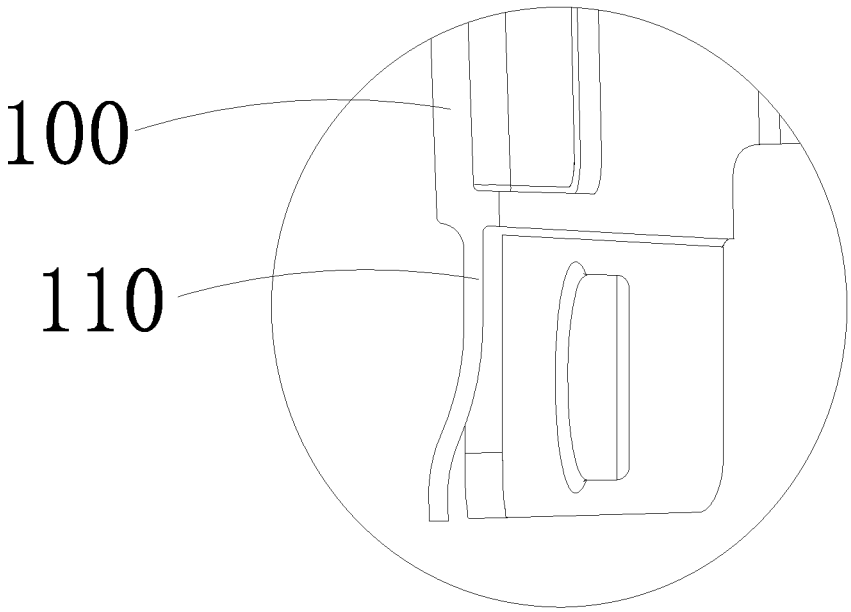

As shown in FIG. 6 and FIG. 7, the elastic plastic part 110 has a sheet shape, one side of the elastic plastic part 110 is connected with the lower seal panel 100, while the other sides of the elastic plastic part are separated from the lower seal panel 100, which can be machined by means of disposing a kerf at each of the two sides of the elastic plastic part 110. The fixed end of the elastic plastic part is the end being connected with the lower seal panel 100, the other end is a free end. The elasticity and the reliability of the elastic plastic part 110 can be enhanced through the arrangement of the kerfs, so that the service life of the elastic plastic part 110 can be prolonged.

Furthermore, the distal end of the elastic plastic part 110 away from the side connected to the lower seal panel 100 is inclined outwards from the lower seal panel 100, that is to say, the free end of the elastic plastic part 110 is inclined outwards from the lower seal panel 100. After the lower seal panel 100 has been installed on the main body 300, the compressor is located at the inside of the lower seal panel 100, and the free end of the elastic plastic part 110 is inclined outwards from the compressor.

As one embodiment, in order to save manufacture cost and processing time, the elastic plastic part 110 and the lower seal panel 100 can be machined integrally.

As one embodiment, a latching slot (not shown) is disposed on the front panel 200 at the position corresponding to the position of the elastic plastic part 110 on the lower seal panel 100. The elastic plastic part 110 on the lower seal panel 100 is installed in the latching slot on the front panel 200, which can ensure that the front panel 200 and the lower seal panel 100 are more precisely positioned, and are assembled more tightly. The number of the latching slot is in accordance with the number of the elastic plastic part 110, the latching slot is configured to engage with the elastic plastic part 110. Furthermore, the latching slot is disposed on the front panel 200 at the position corresponding to the position of the elastic plastic part 110.

As one embodiment, the shape of the latching slot is adapted to the shape of the elastic plastic part 110, so as to enable the elastic plastic part 110 to be installed in the latching slot. The elastic plastic part 110 is installed in the latching slot, which can ensure that the front panel 200 and the lower seal panel 100 are more precisely positioned, and are assembled more tightly, so as to prevent the front panel 200 from loosing and releasing, also to avoid abnormal noises generated by the front panel 200 due to shock.

The above-mentioned dehumidifier of the present disclosure has a simple and reasonable configuration, the compressor is arranged in the main body, a lower seal panel is disposed on the outside of the compressor for shielding the compressor and reducing noises produced when the compressor is running; the lower seal panel is positioned between the main body and the front panel, such that, when washing and repairing the dehumidifier, only the front panel 200 needs to be removed, while the compressor is shielded by the lower seal panel, which ensures the security.

What described above are only some embodiments of the present invention, which is more specific and detailed, but not intended to limit the scope of the present disclosure. It should be noted that, to those of ordinary skill in the art, modifications and improvements can be made without departing from the spirit of the present invention, and all of these shall be included within the protection scope of the present invention. Therefore, the protection scope of the present invention should be subject to the appending claims.

What is claimed is:

1. A dehumidifier comprising a main body, a front panel, and a compressor, the compressor being arranged in said main body, and positioned at a bottom of said main body, said front panel being arranged on an outside of said main body;

the dehumidifier further comprising a lower seal panel for shielding said compressor wherein said lower seal panel is disposed on said main body and positioned between said front panel and said compressor, wherein at least one elastic member is disposed between said lower seal panel and said front panel, the elastic member having a top end and a bottom end opposite the top end, wherein the top end of the elastic member is connected at a lower end edge of the lower seal panel, wherein the elastic member is securely attached to the front panel and configured to prevent the front panel from loosening and releasing, wherein the elastic member is generally inclined outwards and downwards from the lower end edge of the lower seal panel to the front panel, such that the bottom end of the elastic member is closer to the front panel than the top end of the elastic member, and such that the bottom end of the elastic member is vertically lower than the top end of the elastic member, wherein the elastic member comprises an upper sheet portion extending downwards from said top end, and a lower sheet portion extending upwards from said bottom end, wherein said upper sheet portion and said lower sheet portion are horizontally offset from one another, wherein said upper sheet portion and said lower sheet portion are in parallel planar alignment with a major vertical plane of the lower seal panel and with a major vertical plane of the front panel, and wherein said lower sheet portion is configured to engage and install into a corresponding latching slot on the front panel.

2. The dehumidifier according to the claim 1, wherein, said elastic member is fixedly disposed on said lower seal panel.

3. The dehumidifier according to the claim 2, wherein, said elastic member is an elastic plastic part or a spring.

4. The dehumidifier according to the claim 3, wherein, said elastic plastic part has a sheet shape, and comprises multiple elastic members uniformly distributed along said edge of said lower seal panel, wherein the multiple elastic members are separated by kerfs at sides of the elastic members, and wherein the multiple elastic members are configured to engage and install into corresponding latching slots on the front panel for secure and precise positioning of the lower seal panel with respect to the front panel.

5. The dehumidifier according to the claim 3, wherein, said elastic plastic part and said lower seal panel are formed integrally.

6. The dehumidifier according to the claim 3, wherein, the latching slot is disposed on said front panel at a position corresponding to a position of said elastic plastic part disposed on said lower seal panel.

7. The dehumidifier according to the claim 6, wherein, the shape of said latching slot is adapted to the shape of said elastic plastic part.

8. The dehumidifier according to the claim 1, wherein, at least one elastic member are distributed uniformly along the edge of the lower seal panel.

9. A dehumidifier comprising:

a main body;

a compressor arranged in the main body and positioned at the bottom of the main body;

a front panel;

a lower seal panel positioned between the front panel and the compressor; and an elastic member having a first end and a second end, opposite the first end, wherein the first end of the elastic member is connected to the lower seal panel at an edge of the lower seal panel, and wherein the second end of the elastic member is connected to the front panel such that the elastic member is generally inclined diagonally from the lower seal panel towards the front panel, and such that the first end of the elastic member is both vertically and horizontally transverse from the second end of the elastic member, wherein the elastic member comprises a first sheet portion extending from the first end, and a second sheet portion extending from said second end, wherein said first sheet portion and said second sheet portion are horizontally offset from one another, wherein said first sheet portion and said second sheet portion are in parallel planar alignment with a major vertical plane of the lower seal panel and with a major vertical plane of the front panel, and wherein the second sheet portion is configured to engage and install into a corresponding latching slot on the front panel wherein the lower seal panel is arranged for shielding the compressor, and for reducing noise produced when the compressor is running.

10. The dehumidifier of claim 9, wherein the elastic member is configured to engage with and install into the latching slot at the second end of the elastic member, for secure and precise positioning of the lower seal panel with respect to the front panel.

11. The dehumidifier of claim 9, comprising multiple elastic members uniformly distributed along said edge of said lower seal panel.

12. The dehumidifier of claim 11, wherein the multiple elastic members are separated by kerfs at sides of the elastic members, and wherein the multiple elastic members are configured to engage and install into corresponding latching slots on the front panel for tight and precise positioning of the lower seal panel with respect to the front panel.

13. The dehumidifier of claim 9, wherein the first end of the elastic member is vertically higher and horizontally closer to the lower seal panel than the second end of the elastic member.

* * * * *